US005181392A

United States Patent [19]

Itoh et al.

[11] Patent Number: 5,181,392

[45] Date of Patent: Jan. 26, 1993

[54] AIR CONDITIONER AND HEAT EXCHANGER USED THEREIN

[75] Inventors: Masaaki Itoh, Tsuchiura; Hiroaki Matsushima, Ryugasaki; Hiroshi Kogure, Sano; Mitsutaka Shizuya, Ryugasaki; Chie Kobayashi, Ibaraki, all of Japan

[73] Assignee: Hitachi Ltd., Tokyo, Japan

[21] Appl. No.: 655,144

[22] Filed: Feb. 13, 1991

[30] Foreign Application Priority Data

Mar. 2, 1990 [JP] Japan ..... 2-049268

[51] Int. Cl.[5] ..... F25B 13/00; F25B 39/04

[52] U.S. Cl. ..... 62/160; 62/184; 62/197; 62/210; 62/222; 62/228.4; 62/507; 165/29

[58] Field of Search ..... 62/183, 160, 506, 507, 62/428, 429, 228.1, 228.3, 228.4, 228.5, 324.1, 180, 181, 184, 197, 196.1, 222, 210; 165/150, 921, 112, 113, 29

[56] References Cited

U.S. PATENT DOCUMENTS 2,921,448 1/1960 Carraway ..... 62/507 X
4,266,405 5/1981 Trask ..... 62/314.1 X

FOREIGN PATENT DOCUMENTS 49757 5/1975 Japan .
108394 6/1983 Japan .
1520 1/1987 Japan .

*Primary Examiner*—Harry B. Tanner

[57] ABSTRACT

Disclosed is an air conditioner and, in particular, an air conditioner which is capable of blowing out warm air in heating mode. In the air conditioner of this invention, the condenser is thermally separated into an air-upstream-side and an air-downstream-side heat exchanger, and the heat exchange capacity of the air-downstream-side heat exchanger is adjusted, so that, under preset operating conditions, the entire refrigerant in the air-downstream-side heat exchanger can be kept in the superheated-gas phase, thus making it possible to blow out warm air having a temperature higher than the condensation temperature. Further, the refrigerant temperature at the outlet of the air-downstream-side heat exchanger is measured by a temperature sensor, and the revolving speed of the compressor, the revolving speed of the fan, etc., is so controlled that the temperature measured is kept at a level higher than the condensation temperature. Thus, under all operating conditions, the entire refrigerant in the air-downstream-side heat exchanger can be kept in the superheated gas phase, thereby making it possible to blow out warm air having a temperature higher than the condensation temperature.

17 Claims, 21 Drawing Sheets

AIR CONDITIONER AND HEAT EXCHANGER USED THEREIN

BACKGROUND OF THE INVENTION

This invention relates to an air conditioner and, in particular, to an air conditioner in a heating mode capable of blowing out warm air in heating mode.

In conventional air conditioners, the heat exchanger on the air upstream side is separated from the heat exchanger on the air downstream side, with the fin pitch of the air-upstream-side heat exchanger being smaller than that of the air-downstream-side heat exchanger, as described in Japanese Patent Examined Publication No. 62-1520 (B). Therefore, it has been necessary to separately prepare the air-upstream-side and air-downstream-side heat exchangers. The known example disclosed in the above-mentioned publication has been applied to an outdoor heat exchanger with the aim of obtaining a supercooled liquid. Relevant known examples include Japanese Patent Unexamined Publication Nos. 50-49757 and 58-108394 (A). Japanese Patent Unexamined Publication No. 50-49757 (A) discloses a heat exchanger in which the refrigerant condenser is formed as a separate component composed of condenser sections including a superheated region, a saturation region, and a liquid region, or in which louver slits are arranged between and in parallel with pipe rows. In the heat exchanger disclosed in Japanese Patent Unexamined Publication No. 58-108394, the condenser has a supercooling section whose pipe diameter is smaller than those of the rest of the condenser sections and holes are punched in the fins, thereby hindering thermal conduction.

The contrivance in the above prior-art examples does not go beyond the provision of a thermally secluded section in the heat exchanger with a view to obtaining a superheated region. No consideration is given to the obtaining of blowout air having a temperature higher than the condensation temperature.

SUMMARY OF THE INVENTION

A first object of this invention is to provide a room air conditioner capable of blowing out warm air having a temperature higher than the condensation temperature in the condenser.

A second object of this invention is to provide a room air conditioner capable of blowing out warm air shortly after it is turned on.

A third object of this invention is to make it possible to perform a dehumidifying operation which allows re-heating after dehumidification, thereby enabling the blowout temperature to be adjusted.

The first object of this invention can be achieved by thermally separating and secluding the heat exchanger, which constitutes the condenser, into an air-upstream-side heat exchanger and an air-downstream-side heat exchanger, and by adjusting the heat exchange capacity of the air-downstream-side heat exchanger. Further, this object can be achieved by measuring the outlet refrigerant temperature of the downstream-side heat exchanger and controlling the revolving speed of the compressor, the revolving speed of the fan, etc. in such a manner that the temperature measured is higher than the condensation temperature.

The second object of this invention can be achieved by controlling a wind directing plate when starting the room air conditioner in such a manner that air which has once been blown out is sucked in again.

The third object of this invention can be achieved, in a separate-type heat exchanger which is integrally formed and thermally separated, by performing dehumidification by the upstream-side heat exchanger and then allowing the dehumidified air to pass through the downstream-side heat exchanger, which has a high temperature.

DESCRIPTION OF THE PREFERRED EMBODIMENTS

An embodiment of this invention will now be described with reference to FIGS. 1 to 18.

Figure 1:
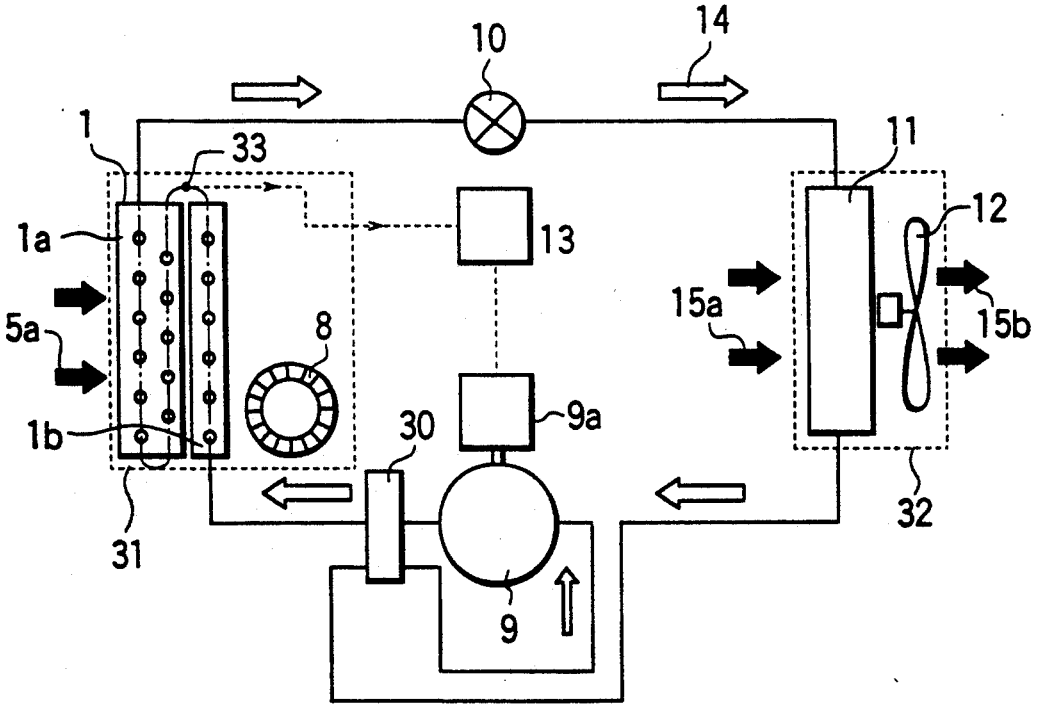
FIG. 1 is a refrigerating cycle block diagram of a room air conditioner constituting an embodiment of this invention.

FIG. 1 is a cycle block diagram of a heat-pump room air conditioner equipped with an inverterdrive compressor 9. This system is composed of the compressor 9, a variable speed motor 9a such as a DC brushless motor (which is contained in the chamber of the compressor 9), a four way valve 30, an indoor unit 31, an expansion valve 10, an outdoor unit 32, a control circuit 13, etc. In a heat-pump room air conditioner, the refrigerant flow direction in the heating mode differs from that in the cooling mode. The following description will be made in connection with the heating mode, which is relevant to this invention. The operation of the compressor 9 causes the refrigerant, whose pressure and temperature have been thereby increased, to pass through the four way valve 30 to enter the indoor unit 31, where it passes through a heat exchanger 1, which is thermally separated into an air-upstream-side heat exchanger 1a and an air-downstream-side heat exchanger 1b. As it passes through this heat exchanger 1, the refrigerant is cooled by the air supplied by an indoor fan 8 to become a liquid refrigerant having a high pressure and temperature, which liquid refrigerant undergoes adiabatic expansion at the expansion valve 10 to become a refrigerant having a low pressure and temperature, which is than evaporated and superheated in the outdoor unit 32 and returned to the suction side of the compressor 9. In this embodiment, a temperature sensor 33 is provided at the outlet for the refrigerant flowing inside the above air-downstream-side heat exchanger 1b (i.e., at the refrigerant inlet of the air-upstream-side heat exchanger), the output of the sensor being fed back to the control circuit 13.

While in the embodiment shown the air-downstream-side heat exchanger 1b usually has a one-row structure, this should not be construed as restrictive.

Figure 2:
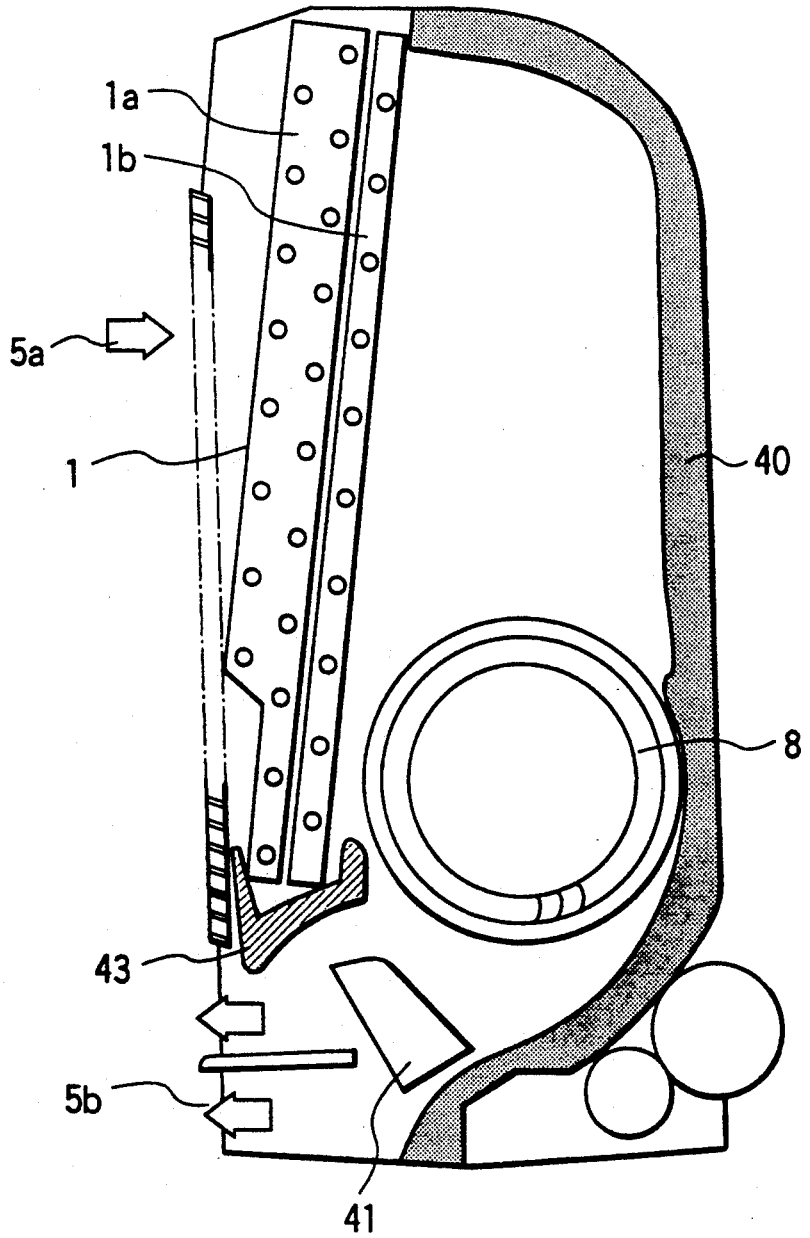
FIG. 2 is a longitudinal sectional view of an indoor unit.

FIG. 2 is an enlarged longitudinal view of the indoor unit 31 shown in FIG. 1. The indoor unit 31, arranged in a case 40, is composed of the indoor heat exchanger 1, the indoor fan 8, a pan 43, a wind directing plate 41, etc. The indoor heat exchanger 1 is separated into the air-upstream-side heat exchanger 1a and the air-downstream-side heat exchanger 1b. Inlet air 5a, which is sucked in by the rotation of the indoor fan 8, is preheated by the air-upstream-side heat exchanger 1a and is further heated by the air-downstream-side heat exchanger 1b to become high-temperature air, which is blown out through an air outlet 5b, with its direction being controlled by the wind directing plate 41.

Figure 3:
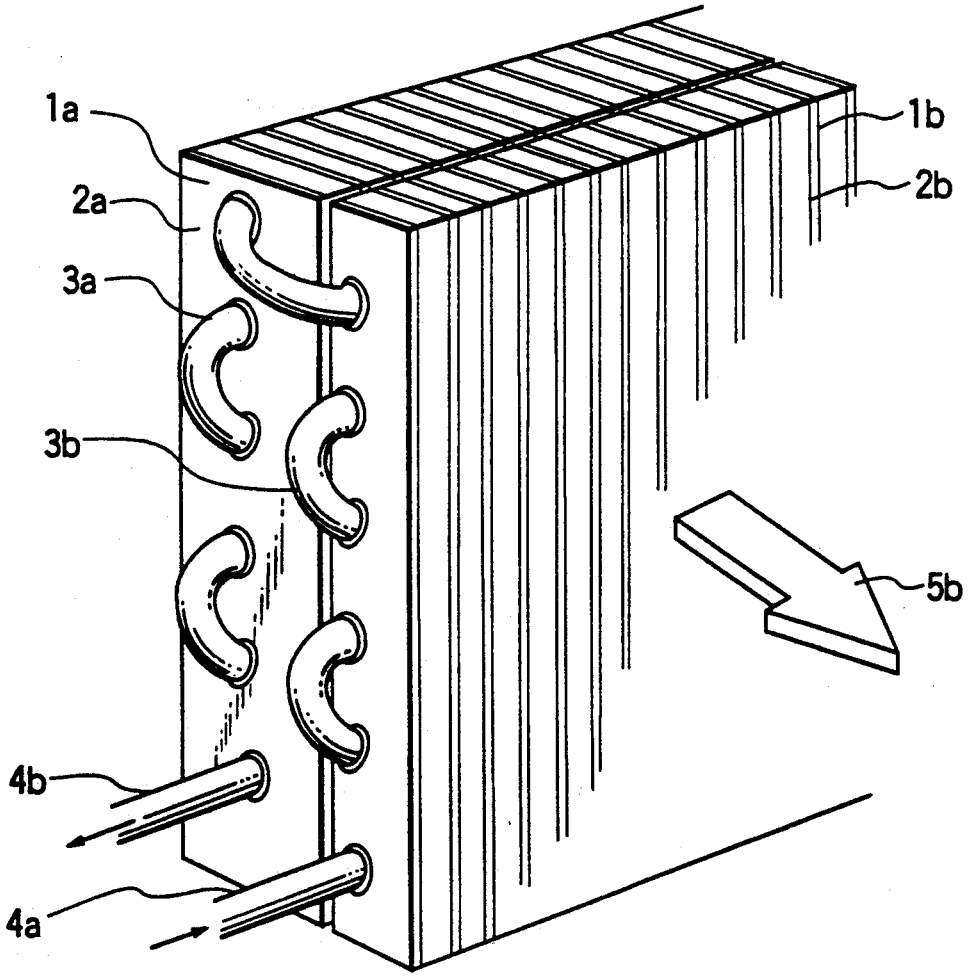
FIG. 3 is a perspective view showing the air and refrigerant flow directions in an indoor heat exchanger.

FIG. 3 illustrates an counter-flow-like flowing mode of the refrigerant and the air. The refrigerant, in the form of superheated gas, enters at a refrigerant inlet 4a and passes through the air-downstream-side heat exchanger 1b by flowing through down-stream-side pipes 3b, thereby attaining a condition which is near saturation. The refrigerant then enters the air-upstream-side heat exchanger 1a and flows through pipes 3a. During this process, the gas refrigerant gradually condenses to diffuse latent heat of condensation, which is used for warming room air, and flows out through a refrigerant outlet 4b with a slight degree of superheating. Roughly speaking, the refrigerant flows from the right to the left, whereas the volume of air flows from the left to the right. This manner of flowing of the refrigerant and the air is called "counter-flow-like" flowing mode.

In this case, the heat exchanger 1 is composed of the downstream-side heat exchanger 1b and the upstream-side heat exchanger la, which are formed integrally and thermally secluded from each other (so that the fin thermal conduction may be hindered 90% or more), and the thermal exchange capacity of the downstream-side heat exchanger 1b is adjusted rather low. The reason for thus adjusting the above capacity is to make the downstream-side heat exchanger 1b a superheated refrigerant gas region so that air can be blown out at a still higher temperature. This will be explained below in detail.

Figure 4:
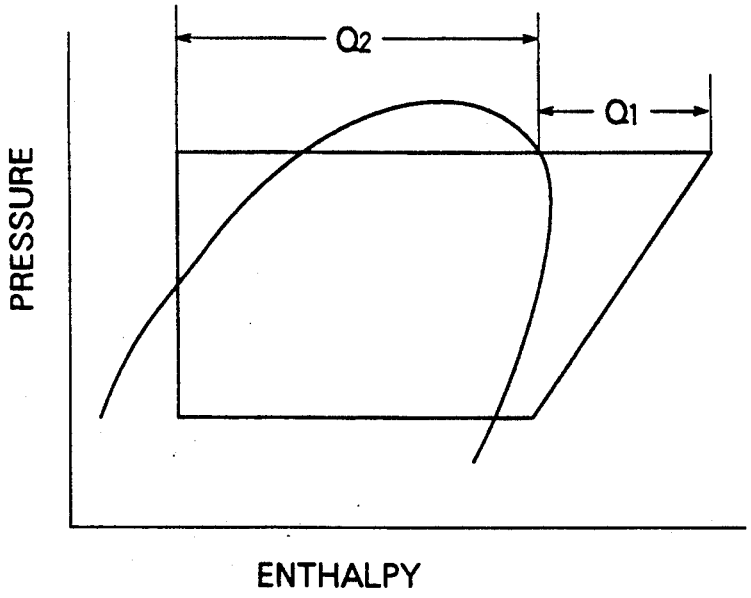
FIG. 4 is a Mollier chart.

FIG. 4 is a Mollier chart showing a refrigerating cycle. The heating capacity is given by $Q_1+Q_2$ in the chart. $Q_1$ represents the superheated gas region and $Q_2$ represents the saturation region and the super-cooled region. In this invention, the system is so set that the one-row heat exchanger on the extreme air downstream side is maintained in the superheated gas state. To effect this, the exchange quantity of heat in that heat exchanger must be $Q_1$ and the exchange quantity of heat of the air-upstream-side heat exchanger must be $Q_2$. Since the inlet air temperature $t_{al}$ and the saturation refrigerant temperature $T_s$ are known, $Q_2$ can be expressed by the following equation (1):

$$Q_2 = \frac{1}{60} C_{pp} V (T_s - t_{a1}) \left(1 - \exp \frac{60 K_2 A_2}{C_{pp} V}\right) \quad (1)$$

where V represents the volume of air per minute ($m^3$/min), $C_p$ the specific heat of air {J/(kg·K)}, and $\rho$ the specific weight of air (kg/$m^3$). The $K_2$ in the last term on the right-hand side represents the over-all heat transfer coefficient {W/($m^2$K)} of the air-upstream-side heat exchanger, and $A_2$ represents the heat transfer area ($m^2$) of the air-upstream-side heat exchanger. By varying the product $K_2A_2$, the exchanger quantity of heat $Q_2$ can be varied. Assuming that the temperature of the air thus heated by $Q_2$ is $t_{a2}$ and that the average value of the superheated refrigerant gas temperature is $T_{gm}$, $Q_1$ can be expressed by the following equation:

$$Q_1 = \frac{1}{60} C_{pp} V (T_{gm} - t_{a2}) \left(1 - \exp \frac{60 K_1 A_1}{C_{pp} V}\right) \quad (2)$$

where $K_1$ and $A_1$ respectively represent the over-all heat transfer coefficient and the heat transfer area of the air-upstream-side heat exchanger. Also in this equation, the exchange quantity of heat $Q_1$ can be varied by varying the product $K_1A_1$.

Figure 6:
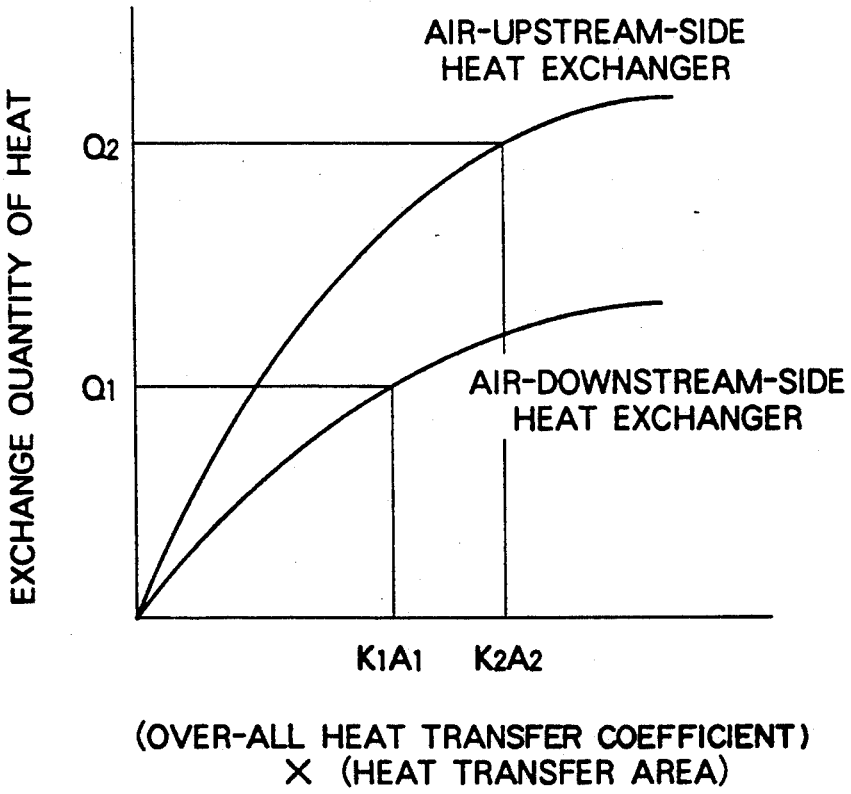
FIG. 6 is a diagram showing the relationship between the product of the over-11 heat transfer coefficient and the heat transfer area and the exchange quantity of heat.

That is, as shown in FIG. 6, augmenting KA results in Q being increased, and reducing KA results in Q being decreased. K may be varied by changing the configuration of fin luvers formed by cutting and raising, and A may be varied by changing the heat exchanger size, the fin width, etc.

Figure 5:
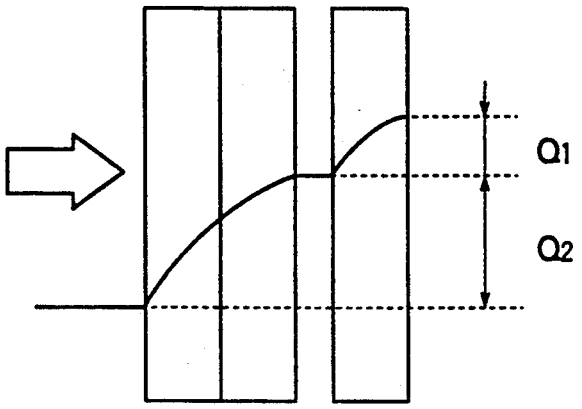
FIG. 5 is a diagram showing the exchange quantity of heat in a heat exchanger.

Thus, as shown in FIG. 5, the exchange quantity of heat $Q_2$ can be obtained on the air upstream side, and the exchange quantity of heat $Q_1$ can be obtained on the air downstream side. As a result, the refrigerant of the air-downstream-side heat exchanger can be maintained in the superheated gas state. By augmenting the exchange quantity of heat $Q_2$ on the air upstream side and reducing the quantity of heat $Q_1$ on the air downstream side, the refrigerant in the air-downstream-side heat exchanger can be maintained in the superheated gas state.

In the following, embodiments of this invention will be described with reference to FIGS. 7 to 14.

Figure 7:
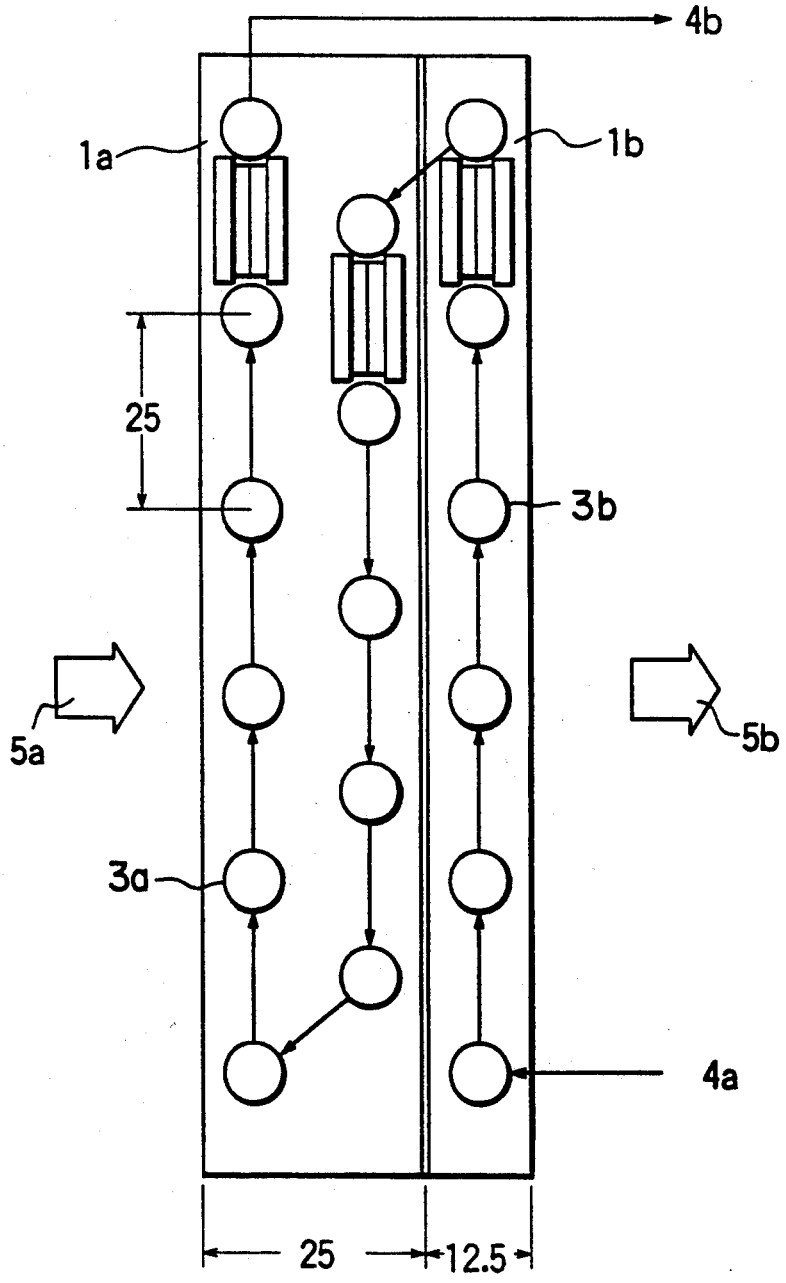
FIGS. 7 to 14 are longitudinal sectional views of heat exchangers.

In the heat exchanger 1 shown in FIG. 7, the width of the upstream-side heat exchanger 1a and that of the downstream-side heat exchanger 1b are set approximately in the proportion of 2:1, as indicated by the dimensions shown. By changing the width of the air-upstream-side fins 1*a* and that of the air-downstream-side fins 1*b*, the refrigerant in the downstream-side pipe 3*b* can be substantially maintained in the superheated-gas state, and the refrigerant in the upstream-side pipe 3*a* can be set in the saturated state. In most cases, the refrigerant exhibits a smaller heat capacity in the superheated-gas state than in the saturated state, so that it is desirable that the width of the downstream-side fins 1*b* be smaller than that of the upstream-side fins 1*a*. Thus, by making the fin widths of the upstream-side and downstream-side heat exchangers 1*a* and 1*b* different from each other while keeping the fin pitches thereof the same, their capacity can be adjusted. As a result, by using integral-type fins having slits, the upstream-side and downstream-side heat exchanges 1*a* and 1*b* can be produced by the same process as that used for producing an integral-type hat exchanger.

Figure 8:
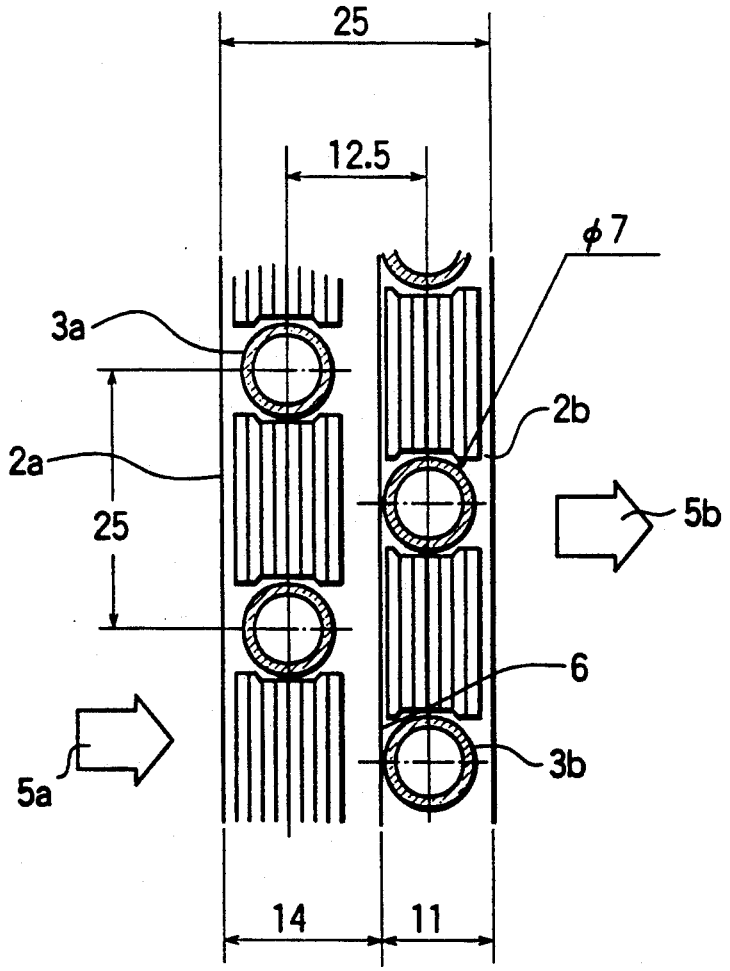

In the heat exchanger 1 shown in FIG. 8, the 25 mm wide louvered fins are separated into 14 mm wide air-upstream-side fins 2*a* and 11 mm wide air-downstream-side fins 2*b*. In this embodiment, the heat exchanging capacity of the downstream-side heat exchanger 2*b* is adjusted by varying the fin width of the heat exchanger 1. The parting line 6 sufficiently functions as such even if fin ends or some fin parts are connected together.

Figure 9:
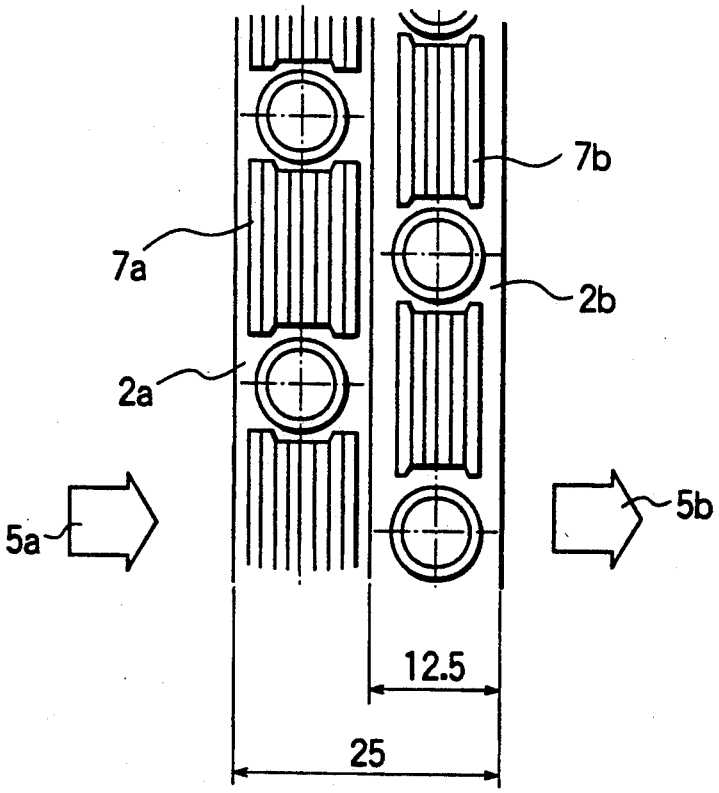

FIG. 9 shows still another embodiment of the heat exchanger 1. The heat exchanger 1 of this invention is divided into substantially equal parts: the upstream-side heat exchanger 2*a* and the downstream-side heat exchanger 2*b*. In this heat exchanger, the number of louvers 7*b* of the air-downstream-side fins 2*b* is reduced so as to lower the heat transfer coefficient, thereby adjusting the heat exchange capacity of the downstream-side heat exchanger 2*b*. It is also possible to lower the heat transfer coefficient by enlarging the width of the louvers 7*b*, thereby obtaining a result similar to that obtained by reducing the fin width.

Figure 10:
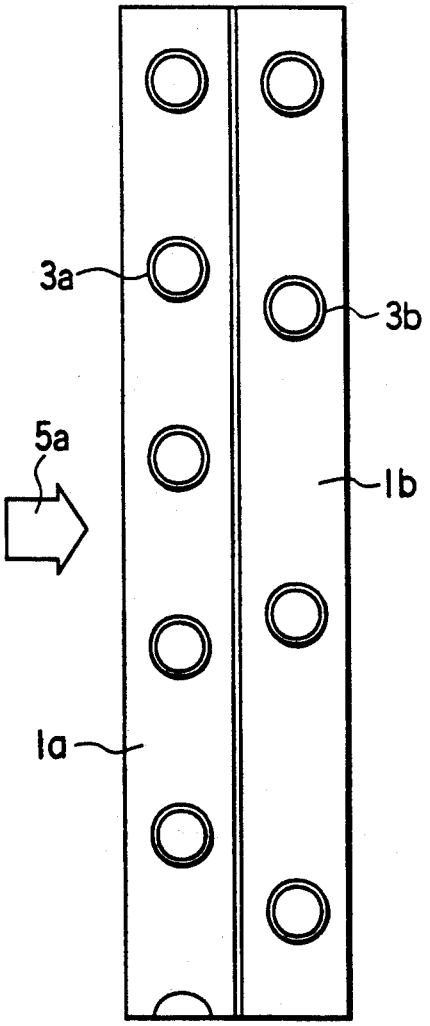

In the heat exchanger shown in FIG. 10, which constitutes a still further embodiment of this invention, the column pitch of the pipe 3*b* of the air-downstream-side heat exchanger 1*b* is set large than the column pitch of the pipe 3*a* of the air-upstream-side heat exchanger 1*a*.

Figure 11:
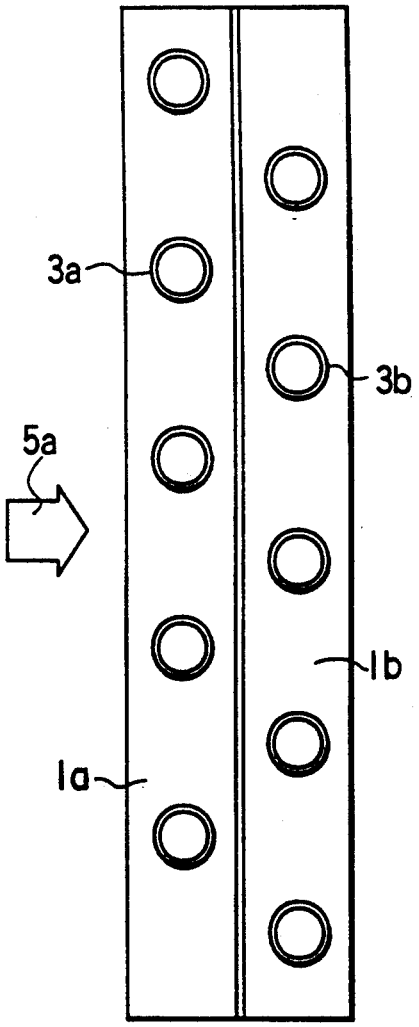

In the heat exchanger shown in FIG. 11, the pipe 3*b* of the air-downstream-side heat exchanger 1*b* is made as a smooth surface pipe, whereas the pipe 3*a* of the air-upstream-side heat exchanger 1*a* has grooves on its inner surface.

Figure 12:
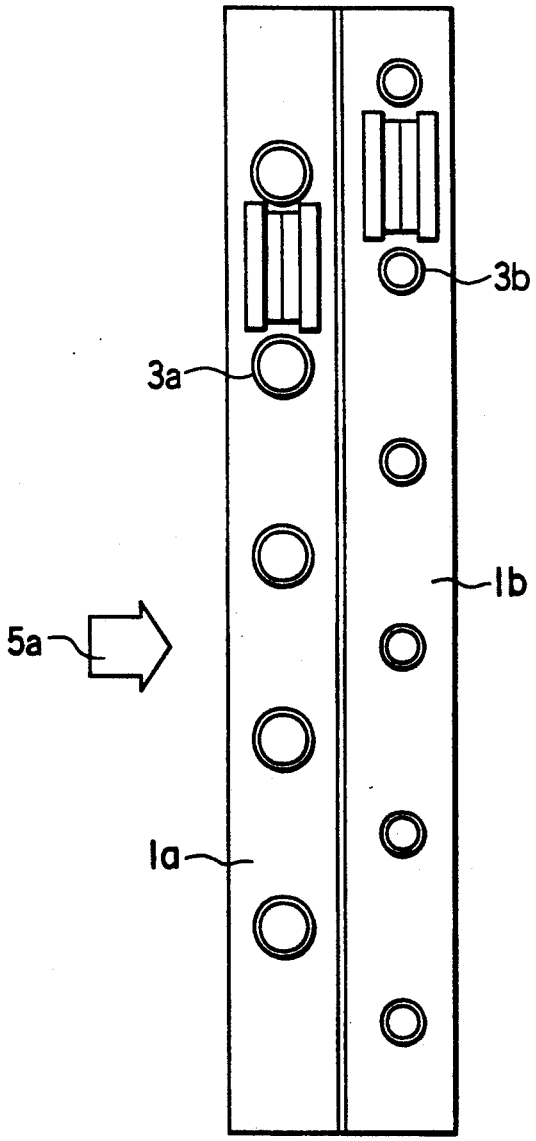

In the heat exchanger shown in FIG. 12, the diameter of the pipe 3*b* of the air-downstream-side heat exchanger 1*b* is set smaller than the diameter of the pipe 3*a* of the air-upstream-side heat exchanger 1*a*.

Figure 13:
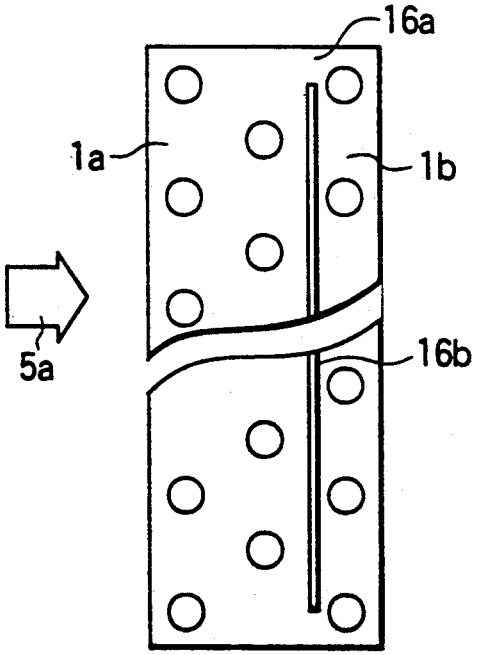

FIG. 13 is a diagram showing an embodiment of this invention in connection with a method of producing a separate-type heat exchanger. In the embodiment shown, a slit 16*b*, which thermally separates the air-downstream-side heat exchanger 1*b* from the air-upstream-side heat exchanger 1*a*, is provided over the length of the heat exchangers except for the upper and lower end portions 16*a* which connect the heat exchangers together. The length of these connecting end portions 16*a* should be very small so that the amount of heat conducted through them may not be excessively large. This arrangement enables a separate-type heat exchanger to be treated as an integral-type fin as in the case of an integral-type heat exchanger. The connecting portions 16*a* may be cut off after the assembly of the heat exchanger.

Figure 14:
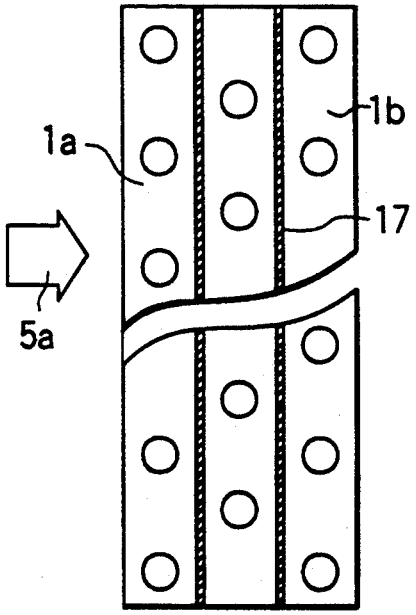
Figure 15:
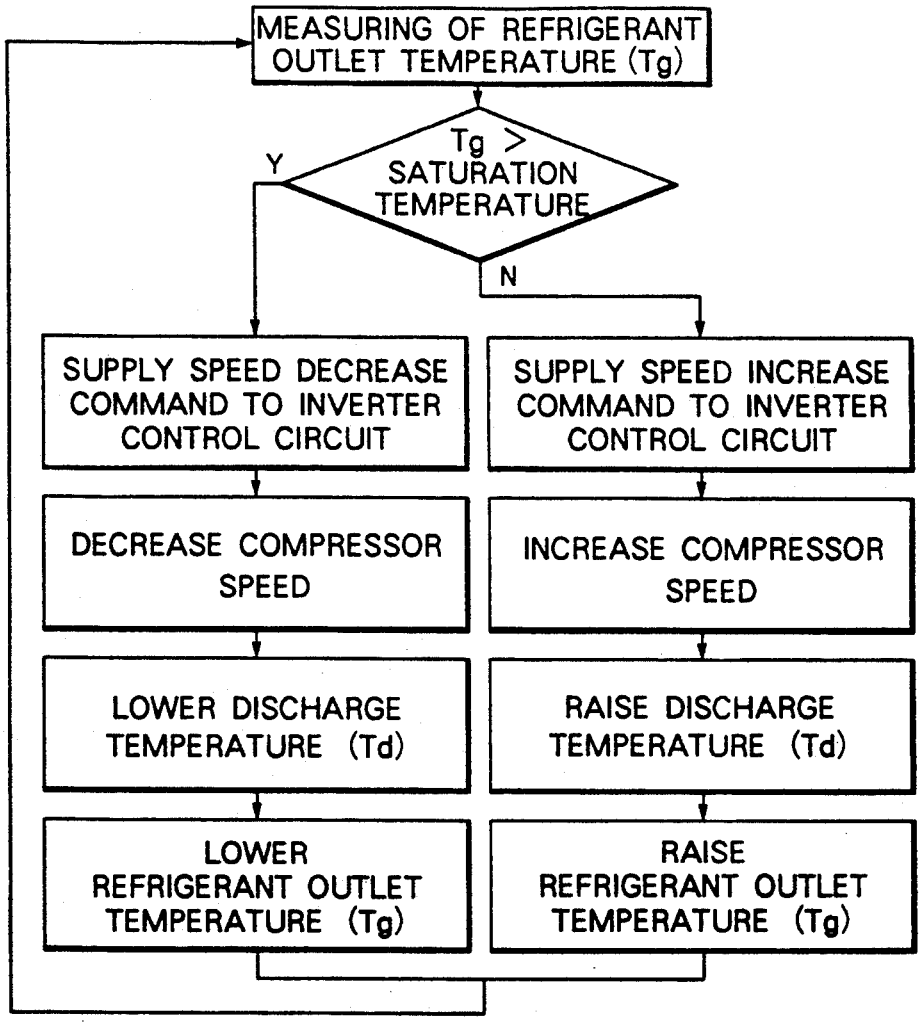
FIG. 15 is a control flowchart.

FIG. 14 is a diagram illustrating another embodiment of this invention along with a method of producing the same. Before forming the fin material into fins, thin strip-like sections 17 having a low thermal conductivity are provided between the pipe rows. These strip-like sections may be formed of a material having a thermal conductivity lower than that of the fin material (which usually is aluminum), or, if formed of the same material as the fins, the thermal conductivity may be lowered by making their thickness extremely small. By using such integral-type fins, a heat exchanger providing the same effect as that of a separate-type heat exchanger can be produced. In the example shown in FIG. 14, two strip-like sections are provided, which proves effective in the case described below. Of course, it is also possible to provide only one strip-like section.

In the case where a non-azeotropic mixture refrigerant is used as the operating refrigerant, temperature gradient is also generated in the saturated stage, so that it is desirable that the fins be separated with respect to the pipe rows. In that case, it is desirable that fins as shown in FIG. 14 be used.

Thus, the heat exchange capacity of the downstream-side heat exchanger 1*b* of a separate-type heat exchanger can be controlled by various means.

As described above, the heat exchange capacity of the downstream-side heat exchanger 1*b* of a separate-type heat exchanger is lowered, thereby making it possible to maintain the refrigerant flowing through this section in the state of the superheated-vapor phase within previously set conditions for the refrigerating cycle. Therefore, as described later, air can be heated in this section, thereby enabling the air conditioner to blow out air having a still higher temperature.

Generally, the conditions for a refrigerating cycle vary depending upon the ambient air temperature, room temperature, etc. In view of this, the following control is to be effected.

In the case of the embodiment shown in FIG. 1, the compressor 9 is inverter-driven, so that the revolving speed of the compressor can be made Accordingly, the circulating refrigerant amount can be varied. If the temperature of the refrigerant flowing inside the air-downstream-side heat exchanger 1*b* of the indoor unit as measured at the outlet of the heat exchanger (i.e., the temperature of the refrigerant as measured at the inlet of the air-upstream-side heat exchanger) is lower than or equal to the saturation temperature, the revolving speed of the compressor is increased by means of the control circuit 13, in accordance with the flowchart shown in FIG. 15. If the temperature measured is higher than the saturation temperature, the revolving speed of the compressor is reduced insofar as the temperature does not become lower than the saturation temperature.

Figure 16:
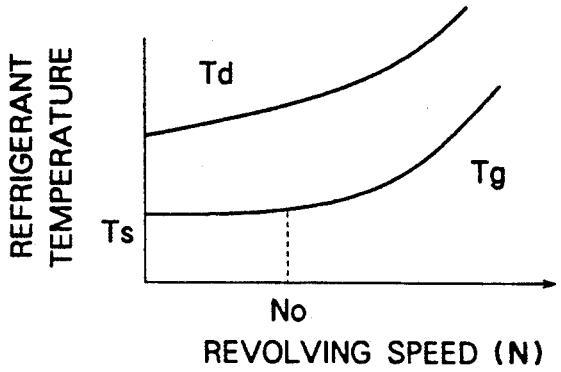
FIG. 16 is a diagram showing the relationship between the revolving speed of the compressor and the refrigerant temperature at the outlet of the downstream-side heat exchanger.

FIG. 16 shows the relationship between the revolving speed N of the compressor, the refrigerant discharge temperature $T_d$, and the outlet refrigerant temperature $T_g$ of the air-downstream-side heat exchanger. It can be seen from this chart that, when the revolving speed N is larger than No, the entire refrigerant flowing through the air-downstream-side heat exchanger 1*b* can be set in the superheated-gas state. By thus changing the revolving speed of the compressor by mans of an inverter or the like, the amount of refrigerant circulating through the cycle is changed, thereby controlling the amount of refrigerant flowing through the downstream-side heat exchanger 1b. As a result, the refrigerant is allowed to flow in an amount which is relatively excessive with respect to the heat exchanger performance, thereby making it possible to constantly maintain the refrigerant flowing inside the air-downstream-side heat exchanger 1b in the superheated-gas state.

Figure 17:
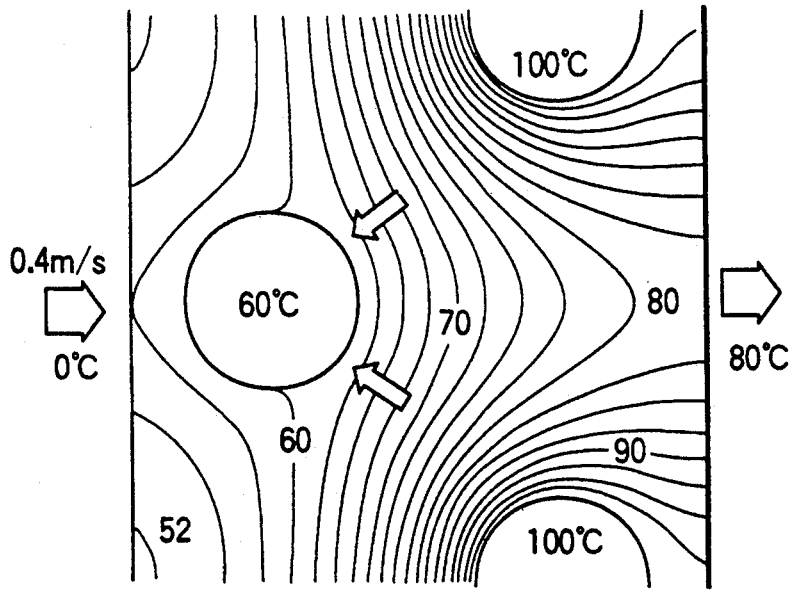
FIG. 17 is a diagram showing an example of temperature distribution in a prior-art fin.

FIG. 17 shows an example of temperature distribution in a conventional integral-type fin. Assuming that the refrigerant temperature on the air upstream side is 60° C. and that the refrigerant temperature on the air downstream side is 100° C., a temperature distribution as shown in the drawing is obtained. As indicated by the arrows in the drawing (which are drawn perpendicular to the isothermal lines to indicate the heat flow directions), the heat of the 100° C. refrigerant flows toward the 60° C. refrigerant. Thus, instead of warming air, it is used for heating refrigerant.

Figure 18:
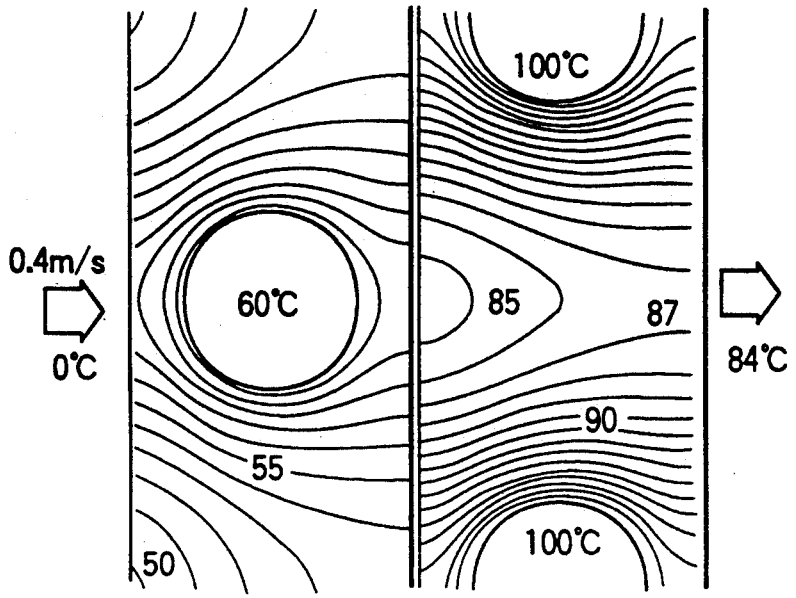
FIG. 18 is a diagram showing an example of temperature distribution in a fin of a separate-type heat exchanger.

FIG. 18 shows an example of fin temperature distribution in a separate-type heat exchanger constructed and controlled in accordance with this invention. For comparison, the conditions are made the same as in the case of FIG. 17. The refrigerant on the air downstream side is at 100° C., and its heat causes the fin temperature of the air-downstream-side heat exchanger 1b to be raised. Thus, as will be appreciated, the ability of the heat exchanger to heat air is made so much the higher.

Thus, it will be understood that the above arrangement proves very effective not so much in the usual heating mode as in a case where blowout air having a high temperature is needed.

Figure 19:
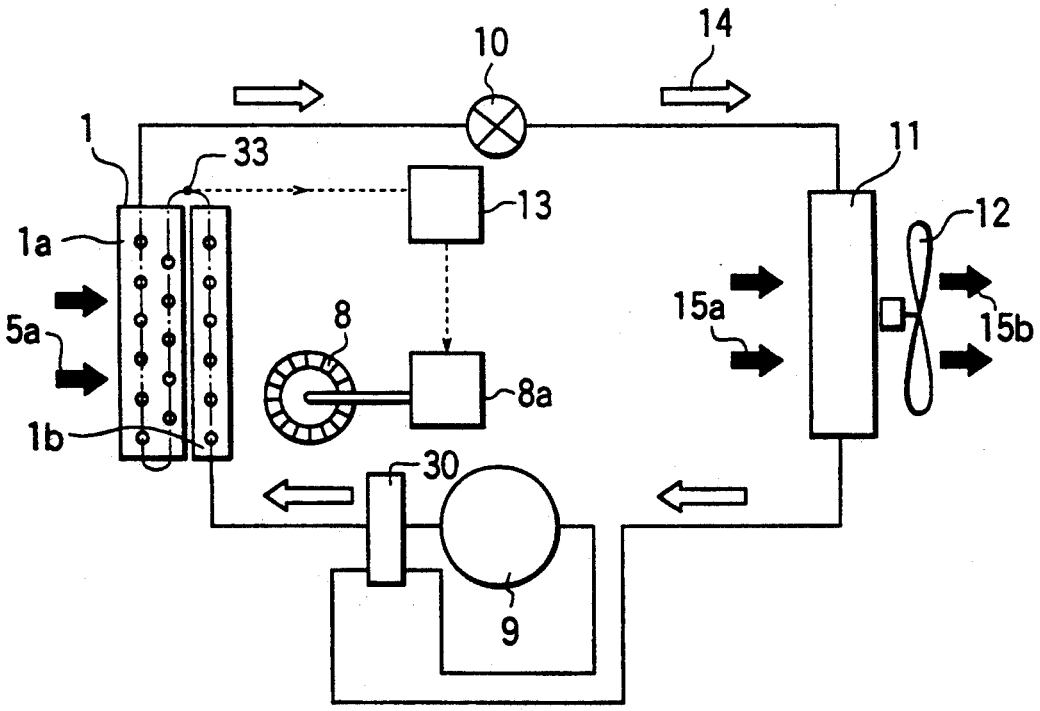
FIG. 19 is a cycle block diagram referring to another embodiment of this invention.

FIG. 19 shows another embodiment of this invention.

Figure 20:
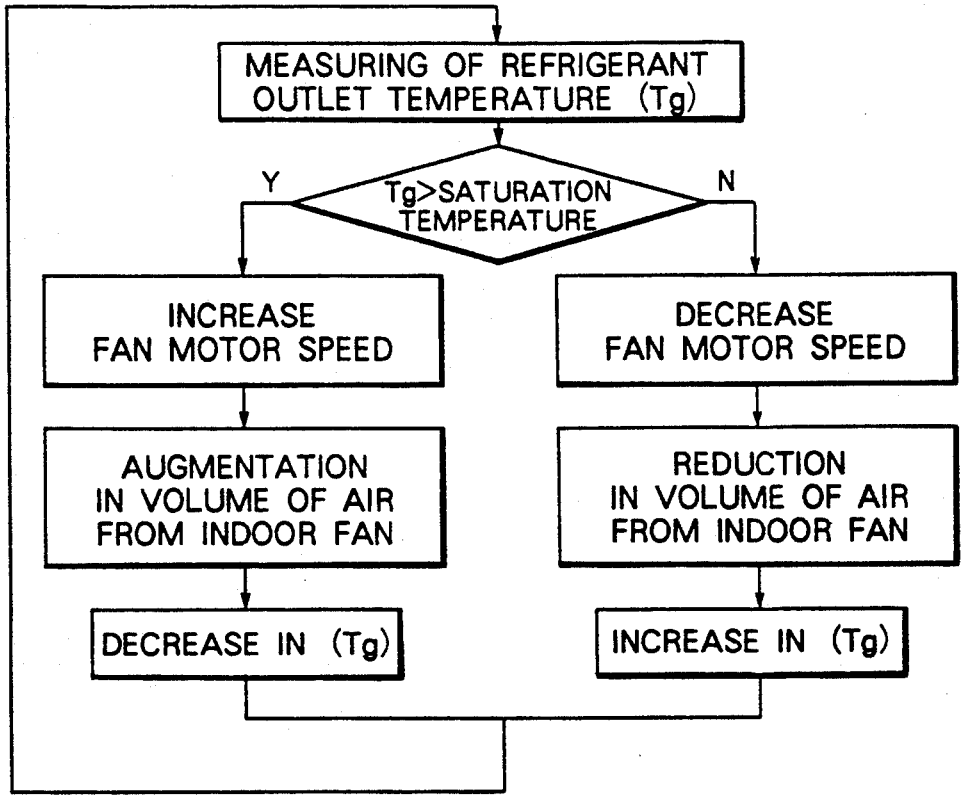
FIG. 20 is a control flowchart.
Figure 21:
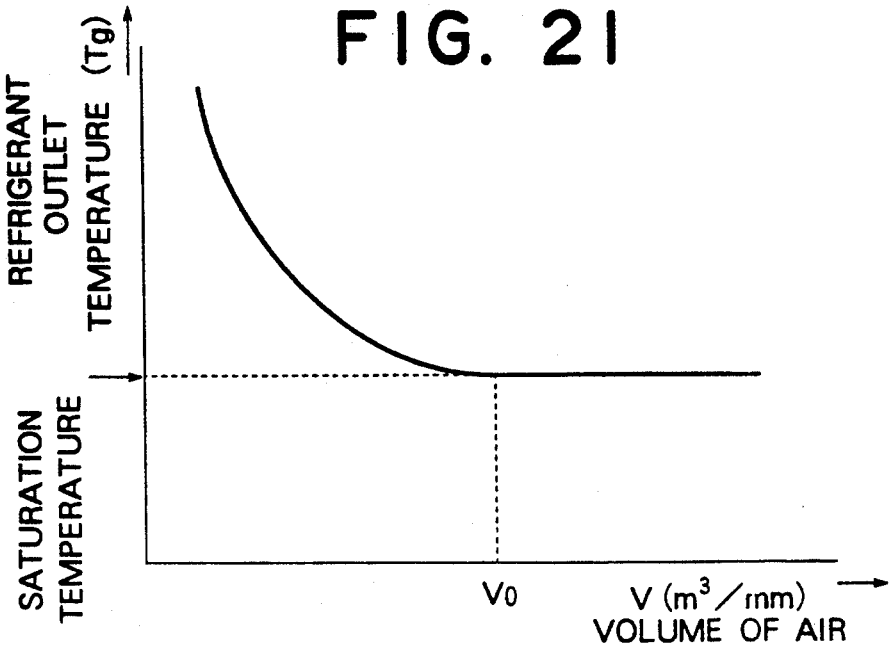
FIG. 21 is diagram showing the relationship between the fan capacity and the refrigerant outlet temperature.

Shown in FIG. 19 is a refrigerant circulation route 14 in a heat pump cycle equipped with a separate-type heat exchanger 1a, 1b in the heating mode. Superheated high-temperature refrigerant gas discharged from the compressor 9 is cooled as it passes through the air-downstream-side heat exchanger 1b and the air-upstream-side heat exchanger 1a in the indoor unit 31 and becomes high-temperature liquid refrigerant, which reaches the expansion valve 10. The two-phase-flow refrigerant expanded under low pressure at the expansion valve 10 vaporizes at the outdoor heat exchanger 11 to become low-pressure vapor, which is absorbed by the compressor 9. In this process, the refrigerant temperature at the outlet of the air-downstream-side heat exchanger 1b (i.e., the refrigerant temperature at the inlet of the air-upstream-side heat exchanger 1a) is measured by the temperature sensor 33. If this temperature is lower than or equal to the saturation temperature, the volume of air from the indoor fan 8 is reduced, in accordance with the flowchart shown in FIG. 20. If it is higher than the saturation temperature, the revolving speed of the indoor fan motor 8a is controlled by the control circuit 13 in such a manner as to augment the volume of air from the indoor fan 8 insofar as the temperature is kept above the saturation temperature. FIG. 21 is a chart on which the above control is based; it shows the relationship between the refrigerant temperature Tg at the outlet of the air-downstream-side heat exchanger and the volume of air V from the indoor fan. When the volume of air is $V_0$ or more, the refrigerant at the outlet of the air-downstream-side heat exchanger is at the saturation temperature. When the volume of air is less than $V_0$, the refrigerant temperature at the outlet of the air-downstream-side heat exchanger is higher than the saturation temperature. That is, when the volume of air V is smaller than $V_0$, the entire refrigerant flowing through the air-downstream-side heat exchanger can be maintained in the superheated-gas state. Accordingly, as stated above, air having a still higher temperature than saturation temperature can be blown out.

Figure 22:
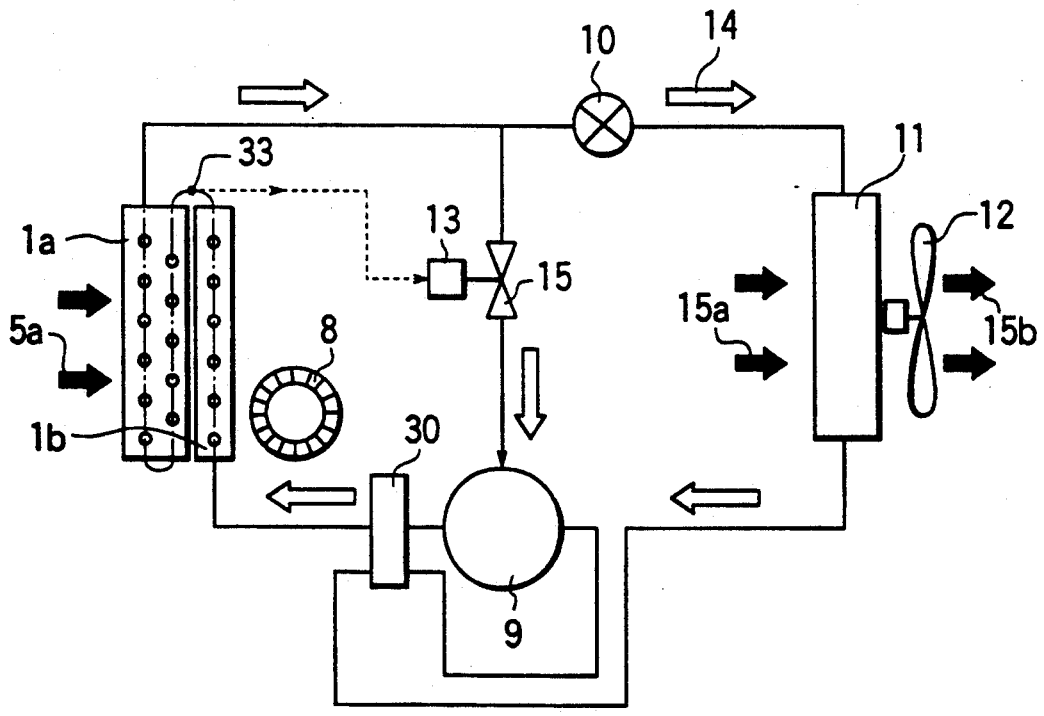
FIGS. 22 and 23 are cycle block diagrams showing further embodiments of this invention.

FIG. 22 shows still another embodiment of this invention.

The embodiment shown in FIG. 22 consists of a heat pump cycle in which high pressure liquid refrigerant is injected through a regulating valve 15 during the compression process of the compressor 9, an operation which is called liquid injection. The refrigerant temperature at the outlet of the air-downstream-side heat exchanger 1b (i.e., the refrigerant temperature at the inlet of the air-upstream-side heat exchanger) is measured by the temperature sensor 33. If the temperature is lower than the saturation temperature, the regulating valve 15 is operated by the control circuit 13 in such a manner that its opening amount is reduced, thereby reducing the injection amount of liquid. If, conversely, the value is above the saturation temperature, the injection amount of liquid is augmented insofar as the temperature does not become lower than or equal to the saturation temperature. As a result, the refrigerant flowing through the air-downstream-side heat exchanger 1b can be constantly maintained in the superheated-gas state. Thus, air having a higher temperature can be blown out.

Figure 23:
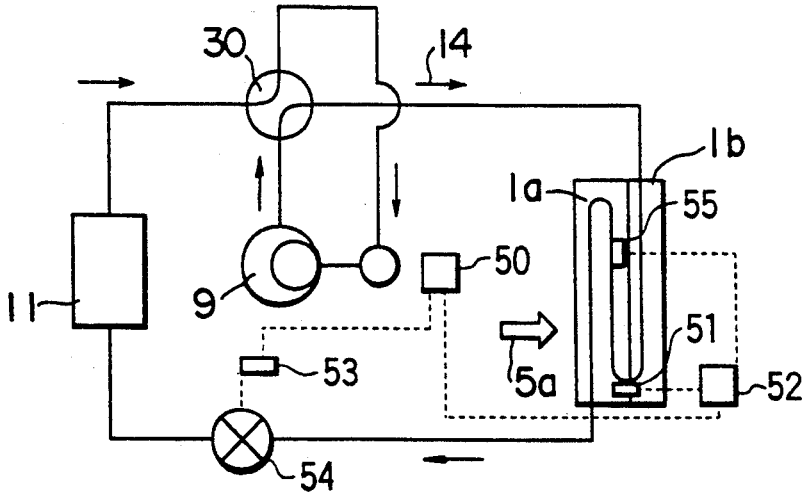
Figure 24:
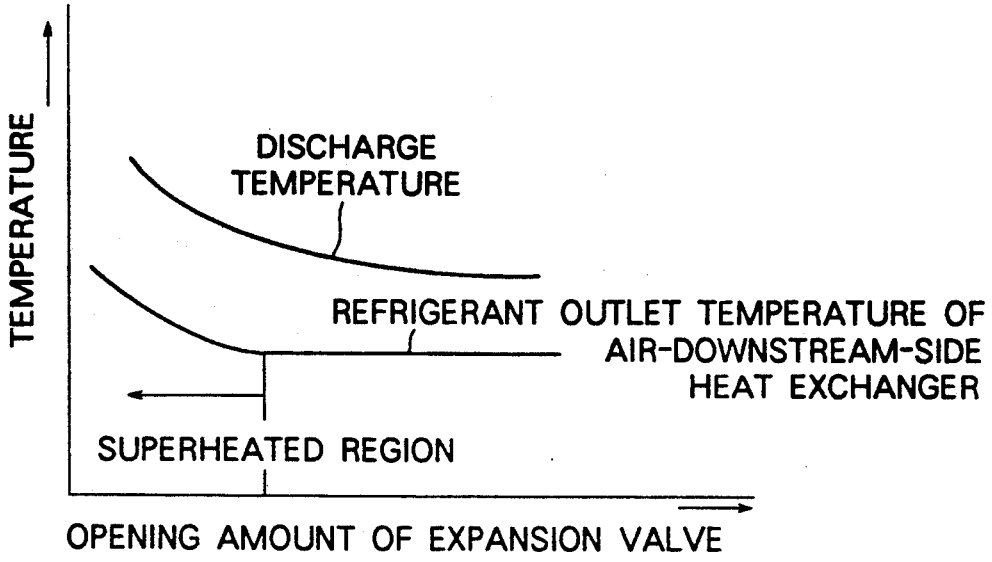
FIG. 24 is a diagram showing the relationship between opening amount of an expansion valve and the temperature in the cyclic construction shown in FIG. 23.

FIGS. 23 and 24 show a still further embodiment of this invention.

FIG. 23 is a refrigerating cycle diagram, and FIG. 24 is a characteristic chart showing the relationship between the opening amount of the electric expansion valve and the discharge temperature.

The cycle shown in FIG. 23 includes a computing unit 50, which transfers an opening amount signal to an electric expansion valve driving device 53 for driving the electric expansion valve 54. The opening amount signal is computed on the basis of a signal from an indoor computing unit 52, which calculates the superheating degree at the refrigerant outlet of the air-downstream-side heat exchanger from signals supplied from a superheating temperature detecting thermistor 51 and a condensation temperature detecting thermistor 55.

The relationship between the opening amount of the electric expansion valve 54 and the discharge temperature and the relationship between this opening amount and the refrigerant temperature at the outlet of the heat exchanger 1b will be explained with reference to FIG. 24. When the opening amount of the electric expansion valve 54 is reduced, the vapor quality (the superheating) at the inlet of the compressor is increased, resulting in the compressor discharge temperature being raised. Accordingly, the superheated region of discharged gas is enlarged. If it exceeds a certain value, the refrigerant at the outlet of the air-downstream-side heat exchanger 1b is also changed to the superheated state.

With the above construction, controlling the opening amount of the electric expansion valve 54 in such a manner that the superheating degree calculated by the indoor computing unit 52 attains a certain preset value (e.g., 2K) results in the refrigerant outlet temperature of the air-downstream-side heat exchanger 1b attaining the level of the superheated state, thereby making it possible to blow out air having a high temperature.

While in this embodiment the superheating degree is obtained from the difference between the temperatures detected by the superheating temperature detecting thermistor 51 and the condensation temperature detecting thermistor 55, the same effect can also be achieved by previously storing the relationship between the discharge temperature and the refrigerant outlet temperature of the air-downstream-side heat exchanger 1b in the computing unit, controlling the discharge temperature by means of the electric expansion valve 54.

Figure 25:
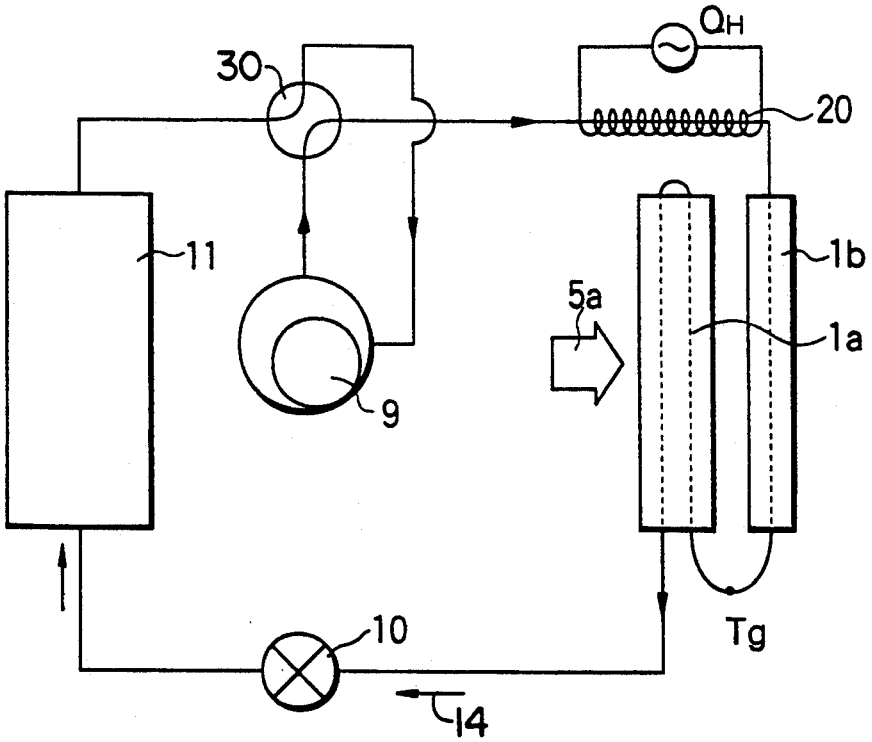
FIG. 25 is a cycle block diagram showing still another embodiment of this invention.
Figure 26:
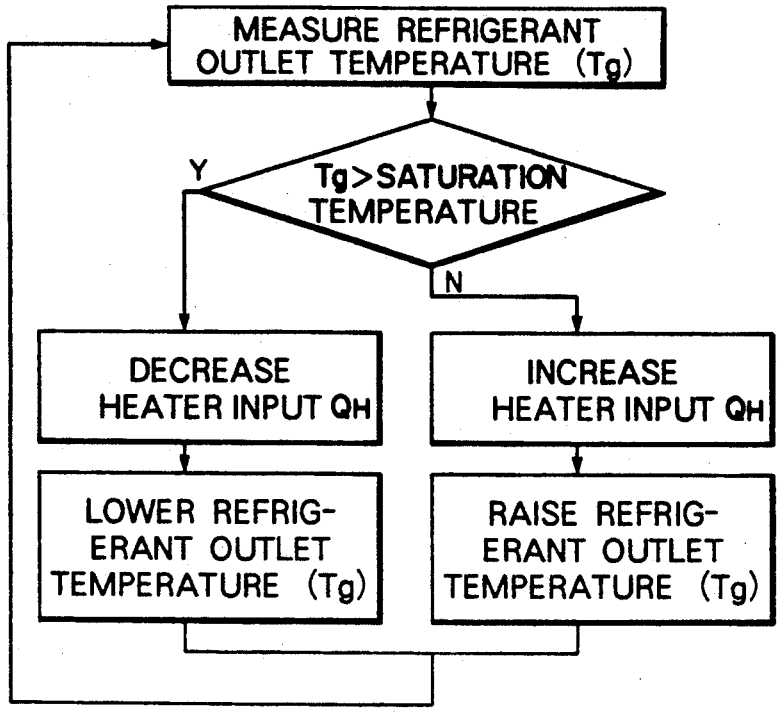
FIG. 26 is a control flowchart thereof.
Figure 27:
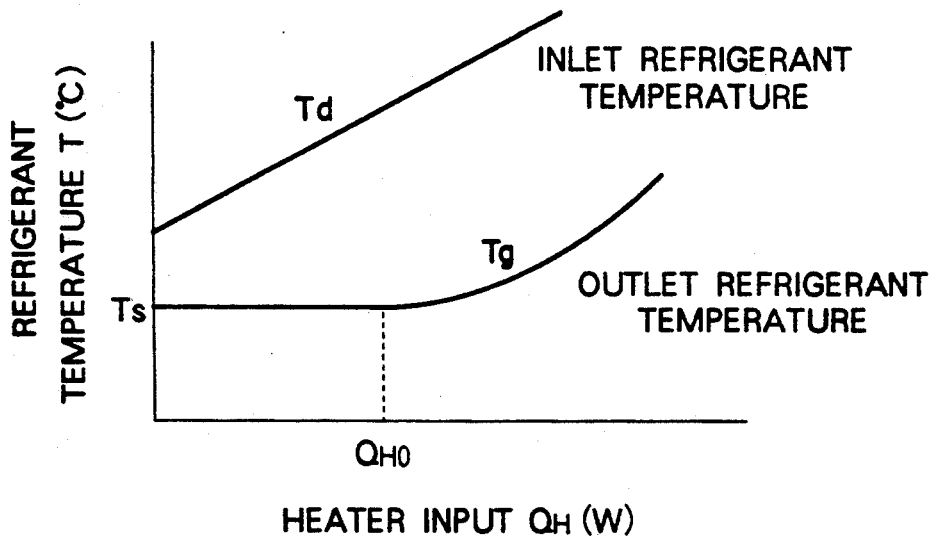
FIG. 27 is a diagram showing the relationship between the heater input and the refrigerant temperature.

FIGS. 25 to 27 show a still further embodiment of this invention. In this embodiment, an electric heater 20 is wound, as shown in FIG. 25, around the refrigerant piping on the inlet side of the air-downstream-side heat exchanger, thereby controlling the outlet refrigerant temperature $T_g$ of the air-downstream-side heat exchanger 1b. FIG. 26 shows the control flowchart for this embodiment. The relationship between the heater input $Q_H$ and the refrigerant temperature is as shown in FIG. 27. The control is effected as follows: the refrigerant temperature $T_g$ of the air-downstream-side heat exchanger 1b is measured. If the temperature is lower than the saturation temperature, the heater input is increased, and, if it is higher than the saturation temperature, the heater input is appropriately adjusted within the range above the saturation temperature.

By setting the heater input at $Q_{HO}$ or more through the above control, the refrigerant in the air-downstream-side heat exchanger can be maintained in the superheated gas phase. As a result, it is made possible to blow out air having a still higher temperature.

A still further embodiment of this invention will be described with reference to FIG. 28.

Figure 28:
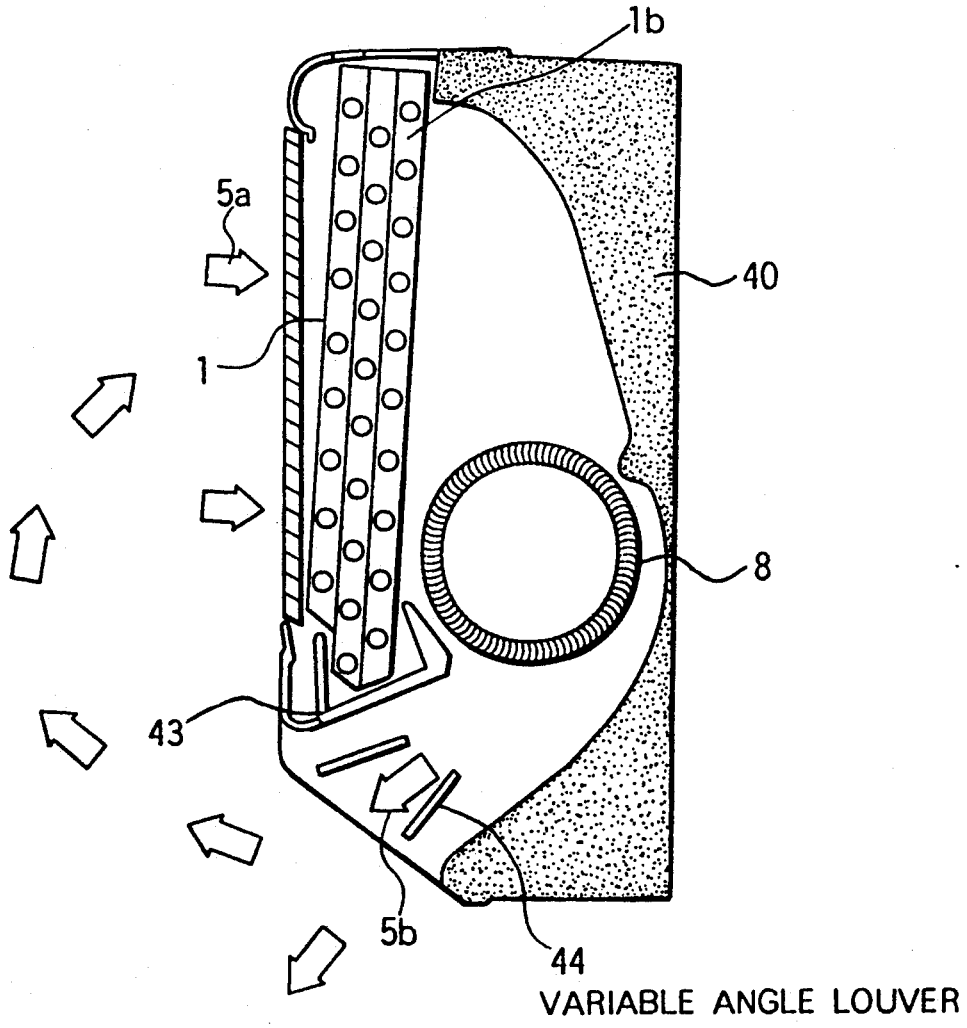
FIG. 28 is a longitudinal sectional view of an indoor unit in a still further embodiment of this invention.

In the embodiment shown in FIG. 28, it is made possible to blow out high temperature air shortly after starting the system. At the time of starting, both the compressor and the heat exchanger are in a cold state, so that it is not easy to obtain warm air quickly. In view of this, the following steps are taken at the time of starting: the volume of air blown out from the indoor unit is reduced, and, at the same time, the blowout angle is adjusted upward, thereby causing at least part of the air once blown out to be sucked in again. Thus, air which is already warm is allowed to enter, with the result that the heat exchanger is quickly warmed and that the discharge pressure of the compressor is rapidly increased, making it possible to quickly blow out air having a high temperature. When a predetermined level of temperature level has been attained, the volume of air is augmented and the blowout angle is changed to downward, thus stopping the re-sucking. In this way, high temperature air which warms the room air down to the foot level can be obtained several minutes after starting. The louvers for adjusting the blowout angle may be controlled on a temperature basis by using a bimetal or a shape memory alloy. Alternatively, optimum angle may be obtained by means of a dedicated motor for angle control.

Figure 29:
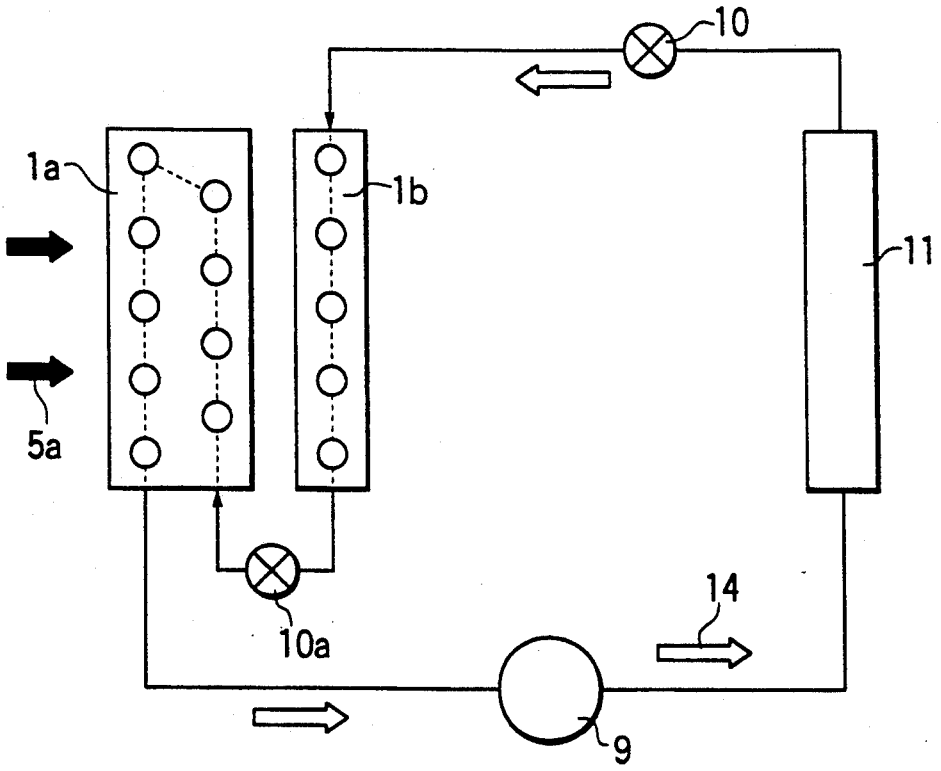
FIG. 29 is a cycle block diagram showing the dehumidifying cycle when performing drying operation with an air conditioner constituting a still further embodiment of this invention.
Figure 30:
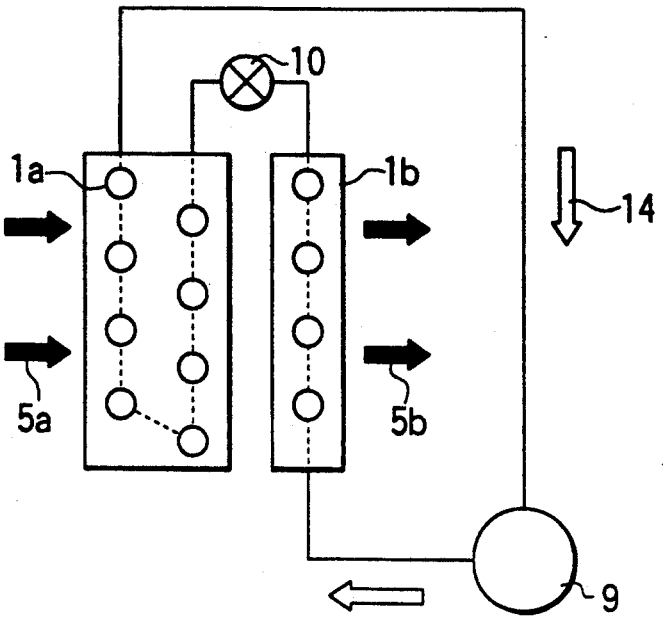
FIG. 30 is a cycle block diagram showing this invention as applied to a dehumidifier.

FIGS. 29 and 30 show a still further embodiment of this invention.

The embodiment shown in FIG. 29 consists of a room air conditioner equipped with a separate-type heat exchanger and having a function of drying operation. In the drawing, the refrigerant flow when performing dehumidifying operation with this air conditioner is indicated.

The cyclic system of the room air conditioner, which is capable of performing drying operation, includes, in addition to the expansion valve 10, a second expansion valve 10a provided between the upstream-side heat exchanger 1a and the downstream-side heat exchanger lb. In the cooling mode, the second expansion valve 10a is opened, the flow restriction being provided by the expansion valve 10. When performing dehumidifying operation, the expansion valve 10 is opened to provide the flow restriction by the second expansion valve 10a.

In the dehumidification cycle shown in FIG. 29, the outdoor heat exchanger 11 and the air-downstream-side heat exchanger 1b are used as the condenser, and the air-upstream-side heat exchanger 1a is used as the evaporator. With this construction, the air cooled and dehumidified by the air-upstream-side heat exchanger is heated by the air-downstream-side heat exchanger, and the temperature of the air blown out can be adjusted. Thus, the air may be just dehumidified, existing the unit, for example, at a temperature substantially equal to the inlet air temperature.

FIG. 30 shows an embodiment of this invention applied to a dehumidifier. In this embodiment, the air-upstream-side heat exchanger 1a is used as the evaporator, and the air-downstream-side air exchanger 1b is used as the condenser. Although the temperature of the outlet indoor air 5b is somewhat higher than the temperature of the inlet air 5a, a sufficient level of dehumidifying function can be provided.

In accordance with this invention, the indoor heat exchanger is divided into an upstream-side heat exchanger and a downstream-side heat exchanger, which are thermally separated from each other. Further, the revolving speed of the compressor fan, etc. is so controlled that the refrigerant temperature at the outlet of the downstream-side heat exchanger is kept above the condensation temperature, so that the refrigerant in the air-downstream-side heat exchanger can be maintained in the superheated phase, thereby making it possible to blow out air having a temperature higher than the condensation temperature.

Furthermore, since the air once blown out in a controlled direction is sucked in again at the start of the room air conditioner, the temperature of the blowout air can be quickly raised to a high level.

In addition, use of an integrally formed and thermally separated heat exchanger enables the once dehumidified air to be heated afterwards, thereby making it possible to adjust the blowout air temperature.

What is claimed is:

1. An air conditioner comprising a system in which the equipment thereof including a compressor, a four-way valve, an indoor heat exchanger equipped with a fan for blowing air into the room, an expansion valve, and an outdoor heat exchanger are connected together in such a manner as to allow a refrigerant to circulate through them and which system is equipped with a control circuit for controlling said equipment.

wherein said indoor heat exchanger is comprised of an air-upstream-side heat exchanger and an air-downstream-side heat exchanger which are thermally separated from each other, wherein a temperature sensor is provided at the outlet of said air-downstream-side heat exchanger, said temperature sensor is provided with an output which is fed back to said control circuit, and wherein said equipment is controlled during the heating operation by said control circuit on the basis of the output of said temperature sensor in such a manner in which said output is kept in a range higher than the condensation temperature.

2. An air conditioner according to claim 1, wherein said indoor heat exchanger which includes said air-upstream-side heat exchanger and said air-downstream-side heat exchanger is adapted to flow a refrigerant and air in a counter flow-like manner; and wherein the relative heat capacities of said air-upstream-side heat exchanger and said air-downstream-side heat exchanger is appropriately proportioned.

3. An air conditioner according to claim 1, wherein in said indoor heat exchanger said air-downstream-side heat exchanger is characterized as having a fin width which is smaller than that in said air-upstream-side heat exchanger.

4. An air conditioner according to claim 1, wherein in said indoor heat exchanger the air-downstream-side heat exchanger includes a relatively smaller number of in louvers.

5. An air conditioner according to claim 1, wherein in said indoor heat exchanger the air-downstream-side heat exchanger thereof is characterized as the exchanger having a relatively smaller number of fin louvers, and that the louvers therein have widths that are relatively larger.

6. An air conditioner according to claim 1, wherein said air-downstream-side heat exchanger is characterized as having a tube pitch which is larger than that of said air-upstream-side heat exchanger.

7. An air conditioner according to claim 1, wherein said indoor heat exchanger is further characterized such that said air-downstream-side heat exchanger includes tubes which have smooth surfaces and said air-upstream-side heat exchanger includes tubes which have grooves on the inner surfaces thereof.

8. An air conditioner according to claim 7, wherein said indoor heat exchanger is further characterized such that said air-downstream-side heat exchanger includes tubes of a diameter smaller than that of said air-upstream side heat exchanger.

9. An air conditioner according to claim 1, wherein said indoor exchanger is further characterized such that said air-downstream-side heat exchanger includes tubes of a diameter smaller than that of said air-upstream-side heat exchanger.

10. An air conditioner according to claim 8, wherein the tube expansion ratio $\epsilon$, where $\epsilon=(d_p-d_f)/d_p$, and where $d_p$ is the tube outer diameter after tube expansion and df is the fin collar inner diameter before tube expansion, of said air-downstream-side heat exchanger is lower than that of said air-upstream-side heat exchanger.

11. An air conditioner according to claim 1, wherein said indoor heat exchanger is further characterized as having a tube expansion ratio $\epsilon$, where $\epsilon=(d_p-d_f)/d_p$, and where dp is the tube outer diameter after tube expansion, of said air-downstream-side heat exchanger which is lower than that of said air-upstream-side heat exchanger.

12. An air conditioner comprising a system in which an inverter-drive compressor, a four-way valve, an indoor heat exchanger, an expansion valve, and an outdoor heat exchanger are connected together in such a manner as to allow a refrigerant to circulate through them and which is equipped with a control circuit for controlling the revolving speed of said compressor, wherein said indoor heat exchanger is comprised of an air-upstream-side heat exchanger and an air-downstream-side heat exchanger which are thermally separated from each other, wherein a temperature sensor is provided at the outlet of said air-downstream-side heat exchanger, said temperature sensor providing an output which is fed back to said control circuit, and wherein the revolving speed of said compressor is controlled during heating operation by said control circuit on the basis of the output of said temperature sensor in such a manner in which said output is kept in a range higher than the condensation temperature.

13. An air conditioner comprising a system in which a compressor, a four-way valve, an indoor heat exchanger equipped with a fan for blowing air into the room, an expansion valve, and an outdoor heat exchanger are connected together in such a manner as to allow a refrigerant to circulate through them and which is equipped with a control circuit for controlling the revolving speed of said fan, wherein said indoor heat exchanger is comprised of an air-upstream-side heat exchanger and in air-downstream-side heat exchanger which are thermally separated from each other, wherein a temperature sensor is provided at the outlet of said air-downstream-side heat exchanger, said temperature sensor providing an output which is fed back to said control circuit, and wherein the revolving speed of said fan is controlled during heating operation by said control circuit on the basis of the output of said temperature sensor in such a manner in which said output is kept in a range higher than the condensation temperature.

14. An air conditioner comprising a system in which a compressor, a four-way valve, an indoor heat exchanger, an expansion valve, and an outdoor heat exchanger are connected together in such a manner as to allow a refrigerant to circulate through them and in which a high-pressure liquid refrigerant is injected through a regulating valve during the compressing process of said compressor, wherein said indoor heat exchanger is comprised of an air-upstream-side heat exchanger and an air-downstream-side heat exchanger which are thermally separated from each other, wherein a temperature sensor is provided at the outlet of said air-downstream-side heat exchanger, said temperature sensor is provided with an output which is fed back to said control circuit, and wherein the opening amount of said regulating valve is controlled during heating operation by said control circuit on the basis of the output of said temperature sensor is such a manner in which said output is kept in a range higher than the condensation temperature.

15. An air conditioner comprising a system in which a compressor, a four-way valve, an indoor heat exchanger, an electric expansion valve, and an outdoor heat exchanger are connected together in such a manner as to allow a refrigerant to circulate through them and which is equipped with a driving device for driving said electric expansion valve and a computing unit adapted to supply an opening amount of signal to said driving device, wherein said indoor heat exchanger is comprised of an air-upstream-side heat exchanger and an air-downstream-side heat exchanger which are thermally separated from each other, wherein a temperature sensor is provided at the outlet of said air-downstream-side heat exchanger, said temperature sensor is provided with an output which is fed back to said computing unit, and wherein the opening amount of said electric expansion valve is controlled during heating operation by said control circuit on the basis of the output of said temperature sensor in such a manner in which said output is kept in a range higher than the condensation temperature.

16. An air conditioner comprising a system in which a compressor, a four-way valve, an indoor heat exchanger, an expansion valve, and an outdoor heat exchanger are connected together in such a manner as to allow a refrigerant to circulate through them, wherein said indoor heat exchanger is comprised of thermally separated two heat exchangers including an air-upstream-side heat exchanger and an air-downstream-side heat exchanger which is equipped with a heater, wherein a temperature sensor, providing an output, is provided at the outlet of said air-downstream-side heat exchanger, and wherein said heat is controlled, via an input thereof, by a control circuit during heating operation on the basis of the output provided by said temperature sensor in such a manner in which said output is kept in a range higher than the condensation temperature.

17. An air conditioner according to claim 12, wherein said indoor heat exchanger is provided in an indoor unit equipped with a blower and louvers for controlling the direction in which air is blown out, and wherein, when starting heating operation, the volume of air from said blower is reduced, with the angle of said louvers being controlled in such a manner that the air once blown out is sucked in again.

* * * * *